US006609629B2

(12) United States Patent
Lucey

(10) Patent No.: US 6,609,629 B2
(45) Date of Patent: Aug. 26, 2003

(54) DRIPLESS PAINT BUCKET

(76) Inventor: John Lucey, 19 Ring Rd., Kingston, MA (US) 02364

( * ) Notice: Subject to any disclaimer, the term of this patent is extended or adjusted under 35 U.S.C. 154(b) by 0 days.

(21) Appl. No.: 10/097,652

(22) Filed: Mar. 13, 2002

(65) Prior Publication Data

US 2002/0139807 A1 Oct. 3, 2002

Related U.S. Application Data

(60) Provisional application No. 60/275,410, filed on Mar. 13, 2001.

(51) Int. Cl.[7] ..... B65D 25/00
(52) U.S. Cl. ..... 220/698
(58) Field of Search ..... 220/698, 702, 220/699–701; 222/570

(56) References Cited

U.S. PATENT DOCUMENTS

| | | | | | |
|---|---|---|---|---|---|
| 1,696,240 | A | | 12/1928 | Kircher, Jr. | |
| 2,601,190 | A | | 6/1952 | Wells | |
| 2,885,108 | A | * | 5/1959 | Donoghue | 220/798 |
| 3,273,746 | A | | 9/1966 | Andrews, Jr. | |
| 3,693,829 | A | | 9/1972 | Price | 220/90 |
| 3,727,792 | A | | 4/1973 | Levin | 220/90 |
| 4,316,560 | A | | 2/1982 | Carter | 222/567 |
| D285,778 | S | | 9/1986 | Smith | D9/434 |
| 4,615,456 | A | * | 10/1986 | Cousar | 220/697 |
| 4,964,527 | A | * | 10/1990 | Martin | 220/698 |
| 5,160,067 | A | * | 11/1992 | Luber | 222/109 |
| 5,913,450 | A | | 6/1999 | Runkel | 220/696 |
| 6,189,725 | B1 | * | 2/2001 | Monico | 220/698 |
| 6,311,862 | B1 | * | 11/2001 | Barnes | 220/698 |

* cited by examiner

*Primary Examiner*—Joseph M. Moy
(74) *Attorney, Agent, or Firm*—George A. Herbster

(57) ABSTRACT

A container having an external gutter located below a primary wiping surface or edge. Drips from the wiping surface to the exterior of the container accumulate in the gutter and drain back into the container through drain holes at the bottom of the gutter.

9 Claims, 4 Drawing Sheets

DRIPLESS PAINT BUCKET

This application claims the benefit of U.S. provisional application serial No. 60/275,410, filed Mar. 13, 2001.

BACKGROUND OF THE INVENTION

1. Field of the Invention

The present invention relates to paint buckets and like containers used commonly by individuals, such as painters, to transport a fluid, such as paint, for application to an object.

2. Description of Related Art

Most painters prefer to work out of paint buckets or containers other than an original paint can for several reasons. First, the original container is less likely to become fouled by paint dripping into the sealing ring. At the end of a session, the painter must clean any excess paint remaining in the sealing grooves. Otherwise it is difficult to reseal. Such improper container sealing may cause paint at the surface in the original can to interact with air and form a film. Secondly a paint bucket enables a painter to portion off only the amount of material needed to complete a job. In the case of quick drying materials, only the amount that can be used within the working life of the material may be portioned off. Third, when painting requires several gallons of paint, multiple original cans can be mixed in one large container and then returned to original containers to assure a more consistent paint color. Then the paint can be poured from the original container into a paint bucket as it is needed. Thereafter, the painter may use smaller amounts of paint in a secondary container to minimize any material spilled should the paint pail become overturned during use.

When painting, a painter dips the brush into the paint to load the bristles. Then many painters remove excess paint by scraping the bristles on the most convenient edge of a pail or attachment, this edge usually being the outermost rim or edge. Eventually paint accumulates on the rim. This paint then drips from the outer scraping edge and either falls onto whatever surface is underneath the paint bucket or runs down the exterior of the bucket to such a surface with possible damage to such a surface.

A number of attachments have been proposed that mount on original paint cans. While generally they are effective in protecting the can and sealing mechanism, they are often ineffective in protecting whatever is underneath the paint can. Paint scraped on the edge of the container is still likely to fall off the container and attachment with nothing to catch the drip. For example, U.S. Pat. No. 4,316,506 to Carter for a paint can dispensing ring attachment discloses a scraping edge. There is no ability for a fluid to be caught if the brush is scraped on an outer lip.

U.S. Pat. No. 3,693,829 to Price for a protective apron for a container again shows an attachment having an external catch trough. The attachment, however, is unable to provide a way for any paint to be returned to the can. Thus, it is likely that under long term use the attachment will fill and overflow causing the same problem it is trying to defeat.

Attachments by definition are not integral to the container. Assembly errors are possible, and an attachment which is not properly seated could give way or snap out of the can rim spilling paint. Attachments also generally extend beyond the sides of the can on which they are placed making it difficult if not impossible to use the handle. Painters, often working from ladders, hang the pails by the handle.

BRIEF DESCRIPTION OF THE DRAWINGS

The various objects, advantages and novel features of this invention will be more fully apparent from a reading of the following detailed description in conjunction with the accompanying drawings in which like reference numerals refer to like parts, and in which.

DESCRIPTION OF ILLUSTRATIVE EMBODIMENTS

Figure 1:
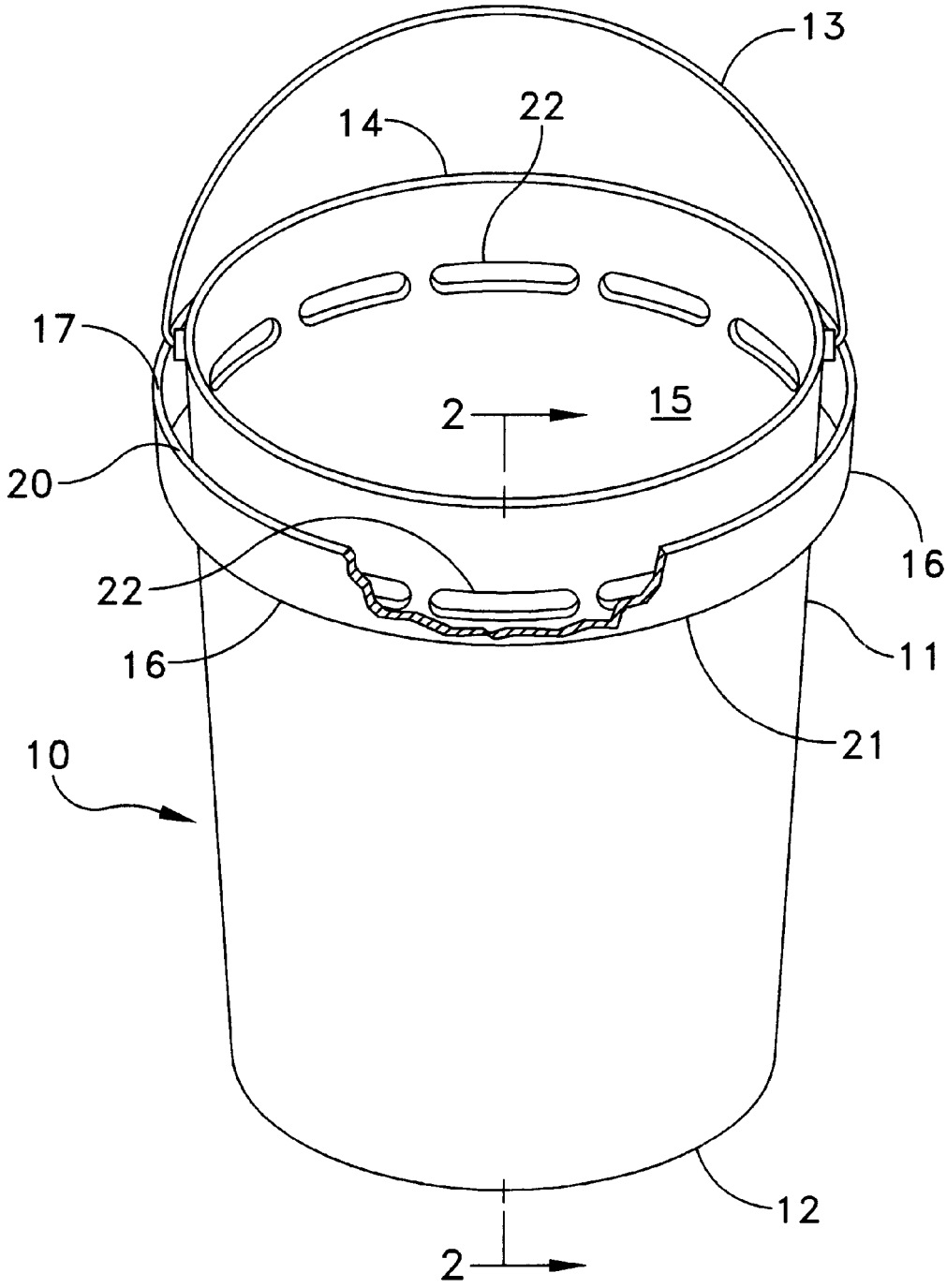
FIG. 1 is a perspective view of a paint bucket constructed in accordance with this invention.
Figure 2:
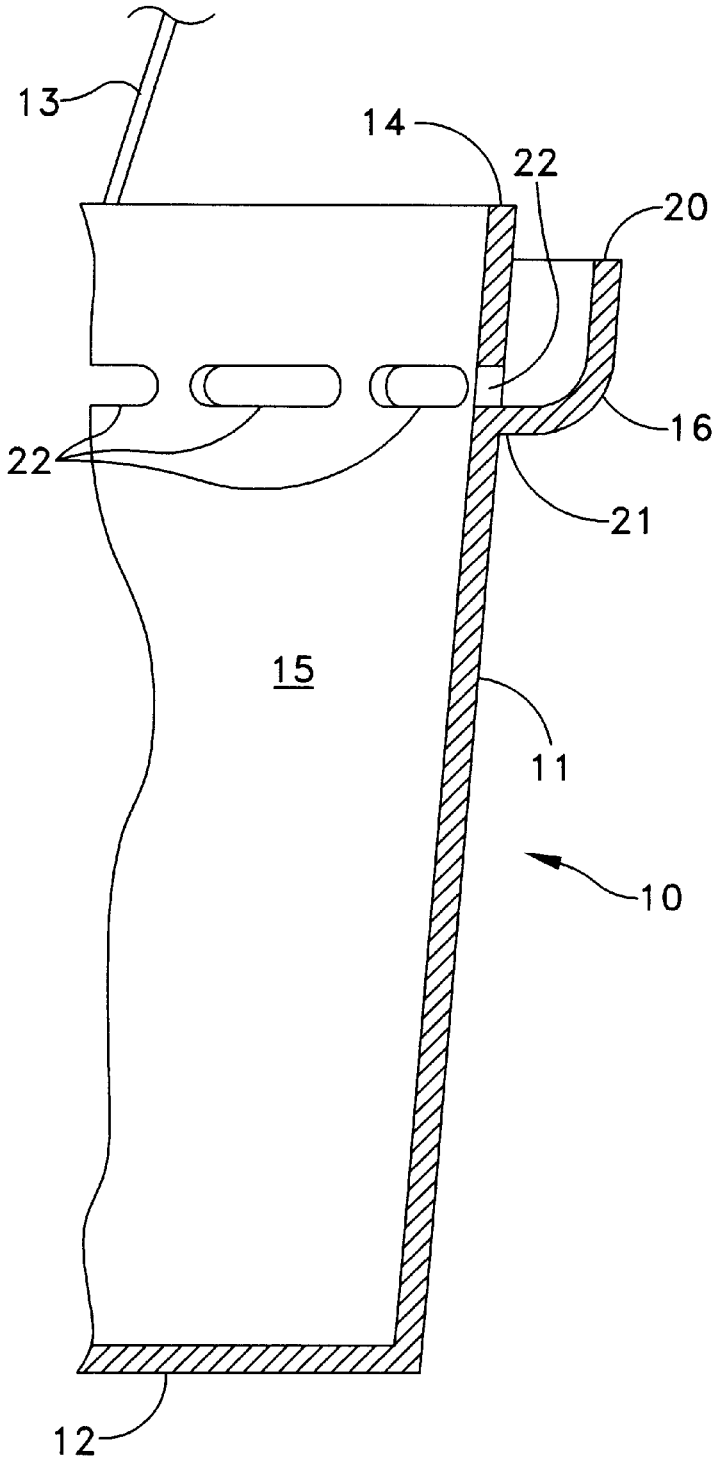
FIG. 2 is a cross section taken along lines 2—2 in FIG. 1 of the pail showing the trough, passages and their proximity to one another.

FIGS. 1 and 2 show a dripless paint bucket 10 constructed in accordance with this invention comprising a molded container with a tapered, conical side wall 11, a bottom closure 12 and an optional handle 13. At the top of the paint bucket 10 a top edge or rim 14 defines an opening into an interior 15 of the paint bucket 10 that stores paint.

The paint bucket 10 has a container circumferential gutter 16 that is integral with side wall 11 and is located below any optional handle attachment 17. An upper, outer edge 20 of the gutter is lies in a plane below the plane of the rim 14. A bottom edge 21 attaches to the side wall 11 immediately below a series of circumferentially spaced apertures or drain holes 22 through the side wall ii. Drain holes 22 prevent the gutter 16 from being filled with paint over time.

Figure 3:
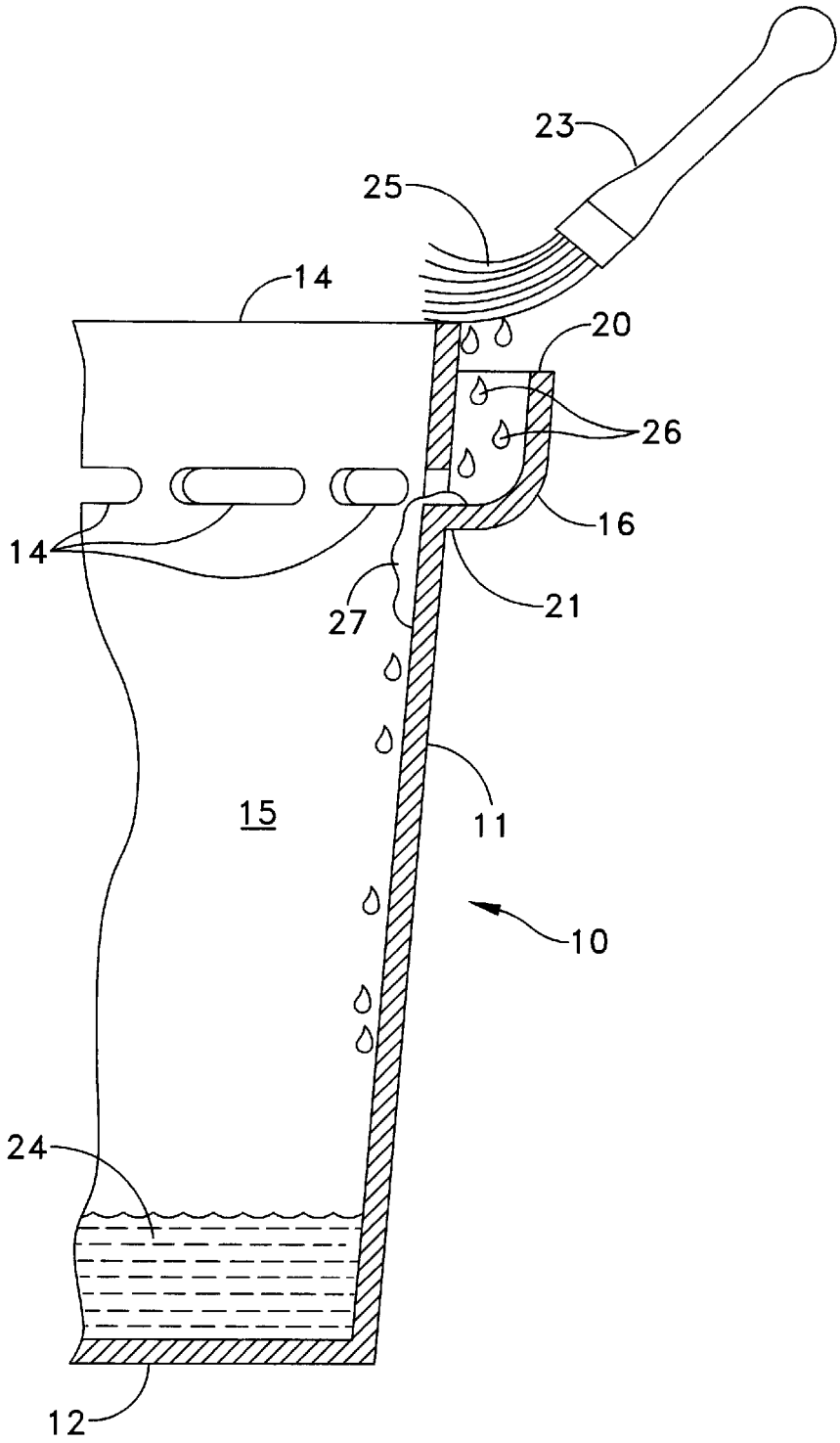
FIG. 3 is a partial cross section of the paint bucket in FIG. 1 to demonstrate its use.

FIG. 3 shows the paint bucket 10 in use. After a paint brush 23 is dipped in paint 24, its bristles 25 are loaded. As the paint brush 23 is withdrawn, the bristles 25 will be drawn across the top rim 14. Most paint normally will run down the inside of the side wall 11. If, however, any paint drips from the outside, as represented by droplets 26, they collect in the bottom of the gutter 16 as paint accumulation 27 and eventually pass through drain holes 22 to the paint 24 in the bottom of the paint bucket 10 protecting whatever is underneath the container.

Figure 4:
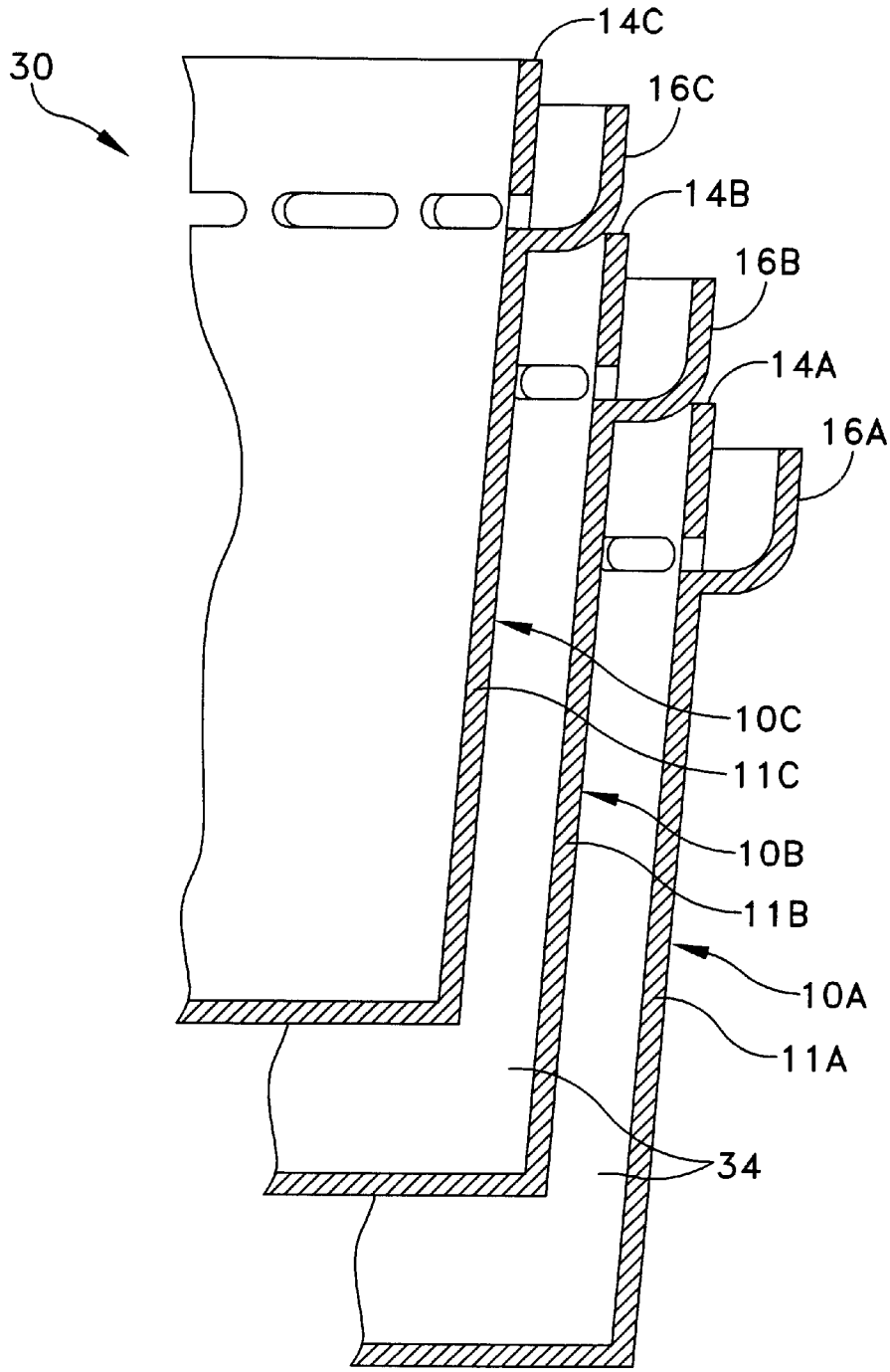
FIG. 4 is a cross section showing multiple stacked paint buckets

From FIG. 2 it is evident that the diameter of the gutter 16 is greater than the outer diameter of the top rim 14. This feature allows the stacking of multiple containers in a nested relationship. For example, FIG. 4 depicts multiple containers 10A, 10B and 10C nested for storage in a stack 30 where a first container 10A receives a second container 10B that in turn receives the third container 10*c*. More specifically, the container 10B nests in container 10A with a surface of its gutter 16B contacting the upper rim 14A. Similarly the paint bucket 14C nests in the paint bucket 14B with the gutter 16C contacting the rim 14B. From FIG. 4 it will also be evident that this stacking occurs without any surface-to-surface contact, so the top paint bucket in a stack, such as the paint bucket 10C is easily removed from the stack 30.

The paint bucket 10, as disclosed in FIGS. 1 through 4 has several advantages. The gutter 16 and drain holes 22 allow excess paint drippings to be caught and returned to the interior of the container for later use rather than fall on a supporting surface. This gutter will not fill and spill over the edge allowing it to better protect the area underneath the container during use. The container has a wiping lip located higher than the gutter outer edge 20 and below the rim 14 allowing the user to scrape excess paint with the majority of the paint flowing directly into the interior 15, so the gutter 16 catches only minimal amounts of paint. In addition, if formed of a molded plastic, the paint bucket 10 is reusable because the design of the gutter 16 and drain holes 22 facilitate cleaning. As a molded integral unit, the paint bucket is subject to inexpensive manufacturing so a painter will be able to afford a collection of these paint buckets and will be able to store them in a minimal volume because they are stackable.

This invention has been disclosed in terms of certain embodiments. It will be apparent that many modifications can be made to the disclosed apparatus without departing from the invention.

What is claimed is:

1. A bucket comprising:

A) a container having an open top defined by top rim a closed bottom and a conical side wall, B) a continuous circumferential gutter formed integrally with the side wall at a location below the top rim, and C) at least one drain slot through the side wall and positioned to open into the gutter.

2. A bucket as recited in claim 1 comprising a handle attachment pivotally attached to said conical wall intermediate said gutter and said rim.

3. A bucket as recited in claim 1 wherein said diameter of said conical wall at said top rim is less than the diameter of said gutter whereby multiple buckets can be stacked in a nested relationship.

4. A bucket as recited in claim 3 comprising a handle attachment pivotally attached to said conical wall intermediate said gutter and said rim.

5. A dripless paint bucket comprising:

A) a molded container with a tapered conical side wall, a bottom closure and a top rim defining an opening into the interior of said container, B) a continuous circumferential gutter formed integrally with said side wall with an outer edge lying in a plane below the plane of said top rim, C) a plurality of circumferentially spaced drain holes through said conical side wall intermediate said attachment of said gutter to said side wall and said top rim whereby any paint that drips from the outside of said top rim collects in the bottom of said gutter to pass through said drain holes into said container.

6. A bucket as recited in claim 5 comprising a handle attachment pivotally attached to said conical wall intermediate said gutter and said rim.

7. A bucket as recited in claim 5 wherein said diameter of said conical wall at said top rim is less than the diameter of said gutter whereby multiple buckets can be stacked in a nested relationship.

8. A bucket as recited in claim 7 comprising a handle attachment pivotally attached to said conical wall intermediate said gutter and said rim.

9. A reusable dripless paint bucket comprising:

A) a molded plastic container with a tapered conical side wall, a bottom closure and a top rim defining an opening into the interior of said container, said top rim having a greater diameter than said bottom closure, B) a continuous circumferential gutter formed integrally with said side wall, said gutter having a bottom edge attached to said conical side wall and with an outer edge lying in a plane below the plane of said top rim and extended beyond the outer diameter of said top rim, C) a plurality of circumferentially spaced drain holes through said conical side wall intermediate said attachment of said gutter to said side wall and said top rim whereby any paint that drips from the outside of said top rim collects in the bottom of said gutter to pass through said drain holes into said container, and D) a handle attached to said conical side wall intermediate said top rim and said gutter whereby said handle and said gutter are free from interference during use and whereby a plurality of said dripless paint buckets of a given size can be stacked in a nested relationship for storage.

* * * * *